US007513391B2

(12) United States Patent
Nakanishi

(10) Patent No.: US 7,513,391 B2
(45) Date of Patent: Apr. 7, 2009

(54) ARTICLE RETRIEVAL EQUIPMENT

(75) Inventor: Yasuyuki Nakanishi, Tochigi (JP)

(73) Assignee: Bandai Co., Ltd., Taito-Ku, Tokyo (JP)

( * ) Notice: Subject to any disclaimer, the term of this patent is extended or adjusted under 35 U.S.C. 154(b) by 172 days.

(21) Appl. No.: 11/299,652

(22) Filed: Dec. 13, 2005

(65) Prior Publication Data

US 2006/0144848 A1 Jul. 6, 2006

Related U.S. Application Data

(63) Continuation of application No. PCT/JP03/09829, filed on Aug. 1, 2003.

(30) Foreign Application Priority Data

Jun. 13, 2003 (JP) ..... 2003-169824

(51) Int. Cl.
*G07F 11/16* (2006.01)

(52) U.S. Cl. ..... 221/241; 221/97; 221/193; 221/237; 221/203; 221/265

(58) Field of Classification Search ..... 221/97, 221/193, 201, 202, 203, 237, 241, 263, 265
See application file for complete search history.

(56) References Cited

U.S. PATENT DOCUMENTS

| | | | | |
|---|---|---|---|---|
| 3,028,049 | A * | 4/1962 | Eppy | 221/154 |
| 5,176,290 | A * | 1/1993 | Schwarzli | 221/203 |
| 5,191,998 | A * | 3/1993 | Schwarzli | 221/203 |
| 5,238,144 | A * | 8/1993 | Kornegay | 221/97 |
| 5,259,532 | A * | 11/1993 | Schwarzli | 221/34 |
| 6,182,859 | B1 * | 2/2001 | Bolen | 221/152 |

FOREIGN PATENT DOCUMENTS

| | | |
|---|---|---|
| JP | 62-20068 | 5/1987 |
| JP | 08-212438 | 8/1996 |
| JP | 2001-209844 | 8/2001 |
| JP | 2001-357448 A | 12/2001 |
| JP | 2002-133492 | 5/2002 |
| JP | 2002-133494 A | 5/2002 |

* cited by examiner

*Primary Examiner*—Gene O. Crawford
*Assistant Examiner*—Timothy Waggoner
(74) *Attorney, Agent, or Firm*—Buchanan Ingersoll & Rooney PC

(57) ABSTRACT

Article retrieval equipment (1) having a portion used by customers arranged at the front of a device body and a portion used by sales persons arranged at the rear of the device body and particularly suitable for use while the sales persons and customers are positioned face-to-face with each other, comprising an article storage chamber (3) for storing articles (A) and a control room (5) for storing a power transmission means (95) and a coin selector (100), wherein a rotary disk (36) for feeding the articles (A) to an article outlet (72) is fitted to the bottom wall (6) of the article storage chamber (3), the article outlet (72), an operation part (81) for rotating the rotary disk (36), and a coin inlet (102) are formed at the front of an equipment body (2), a controlling opening (60) for controlling the power transmission means (95) and allowing a coin storage case (115) to be withdrawn and an access opening (16) for accessing the articles (A) in the article storage chamber (3) are formed at the rear of the equipment body (2), and a cover member (150) for the access opening (16) and the controlling opening (60) are further installed on the equipment.

5 Claims, 10 Drawing Sheets

ARTICLE RETRIEVAL EQUIPMENT

TECHNICAL FIELD

The present invention relates to an article retrieval equipment from which articles such as capsules arranged in an equipment body can be retrieved one by one by operating the operation part of the equipment body.

BACKGROUND ART

Conventionally, an article retrieval equipment from which articles such as capsules arranged in the equipment body can be retrieved one by one has an article storage chamber for storing the articles such as capsules and a control room for storing a coin selector. A rotary disk having accommodation holes to store articles is pivotally arranged on the bottom wall of the article storage chamber. The bottom wall of the article storage chamber has a falling port which opposes the accommodation holes formed in the rotary disk. The equipment body has a falling passage which opposes the tailing port of the article storage chamber and communicates with an article outlet formed in the lower portion of the equipment body. The equipment body also has an operation part which rotates the rotary disk through a power transmission means to oppose the accommodation holes to the falling port. Then, the articles stored in the accommodation holes fall into the article outlet through the falling port and falling passage. When a coin is inserted in the coin selector from a coin inlet, the rotary disk or power transmission means becomes rotatable. The coin selector has a coin storage case under it.

As disclosed in, e.g., Japanese Utility Model Publication No. 62-20068 (patent reference 1) and Japanese Patent Laid-Open Nos. 2001-209844 (patent reference 2) and 2002-133492 (patent reference 3), a conventional article retrieval equipment has an article outlet, operation part, coin inlet, controlling opening, and a lid member on the front surface of the main body. A power transmission means can be controlled and a coin storage case can be pulled out through the controlling opening. The lid member opens and closes the controlling opening. In the conventional article retrieval equipment, a control room for storing a coin selector is arranged under an article storage chamber where articles such as capsules are stored (for example, patent references 1, 2, and 3).

The conventional article retrieval equipment also has, spaced apart from the controlling opening through which the power transmission means can be controlled and the coin storage case can be pulled out, an access opening through which the articles in the article storage chamber are unloaded and loaded. The controlling opening and access opening are closed with different portions and opened with different procedures (for example, patent references 1, 2, and 3).

The conventional article retrieval equipment is provided with a regulating member which regulates the sizes of the accommodation holes, as disclosed in, e.g., Japanese Patent Laid-Open No. 8-212438 (patent reference 4). When small articles are stored in the article storage chamber, the regulating member prevents a plurality of articles from being stored in one accommodation hole of the rotary disk and from falling to the falling port simultaneously. Also, a display which displays the prices, contents, and the like of the articles is pivotally arranged on the front surface of the conventional article retrieval equipment (for example, patent reference 4).

In the conventional article retrieval equipment described above, portions such as a coin slot, article outlet, and an operation part which are used by a customer, and portions such as a coin storage case which are used by a sales person to replenish the articles and control the coin selector and power transmission means are arranged on the front surface of the equipment body. Both the customer and sales person can access the article retrieval equipment only from the front surface of the equipment body. Therefore, the conventional article retrieval equipment is set to be sandwiched between the sales person and customer. When the sales person and customer are to use the article retrieval equipment face to face, the sales person cannot perform operations such as replenishing the articles and pulling out the coin storage case unless he or she moves to the front surface of the equipment body. This is cumbersome.

In the conventional article retrieval equipment, the portions such as the coin storage case which are used by the sales person to replenish the articles and control the coin selector and power transmission means are also arranged on the front surface of the equipment body. Therefore, the customer may be able to access these portions illegally. For the purpose of security control, the article retrieval equipment must be kept under surveillance.

In the conventional article retrieval equipment, the control room is arranged under the article storage chamber which stores the articles such as capsules, and the coin slot, article outlet, operation part, power transmission mechanism, coin selector, and coin storage case are arranged in the control room. Thus, the article retrieval equipment is large in the longitudinal direction. Such an equipment is unstable and thus not suitable to be set on a table such as a counter provided between the sales person and customer.

In the conventional article retrieval equipment, the controlling opening, through which the power transmission means can be controlled and the coin storage case can be pulled out, and the access opening through which the articles are unloaded and loaded from and in the article storage chamber are closed with the different lid members and locked. Different keys are required to open the two openings. Therefore, for the purpose of management, the sales person must always carry two keys, leading to cumbersome management. As the different lid members are required to close the controlling opening and access opening, it is difficult to make the equipment compact.

The conventional article retrieval equipment is provided with the regulating member which regulates the sizes of the accommodation holes so as to cope with a case wherein small articles are stored in the article storage chamber. As the space between the rotary disk and the bottom wall of the article storage chamber does not change, sometimes an article having a small size may be caught in this space and interfere with the rotation of the rotary disk, likely to break the rotary disk.

In the conventional article retrieval equipment, an opening/closing door which opens only to the article outlet side is provided to the falling passage, so the interior of the article retrieval equipment will not be accessed from the article outlet. If an article to fall is large and heavy, it can push the opening/closing door to open when it rotates by its own weight due to the inclination of the falling passage. If the article to fall is small and lightweight, it cannot push the opening/closing door to open and is stopped by the door.

In the conventional article retrieval equipment, the display which displays the price, contents, and the like of the article is pivotally arranged on the front surface of the equipment. As the display can be pivoted externally, sometimes the display may be pivoted erroneously.

The present invention has been made in view of the above problems. It is the first object of the present invention to provide an article retrieval equipment in which portions such as a coin slot, article outlet, and operation part which are used by the customer are arranged on the front surface of an equipment body, portions such as a coin storage case which are used by the sales person to control the coin selector and power transmission means are arranged on the rear surface of the equipment body, and which is placed between the sales person and customer and particularly suitable to be used by the sales person and customer face to face.

It is the second object of the present invention to provide a compact article retrieval equipment in which a control room provided with a coin slot, article outlet, operation part, power transmission mechanism, coin selector, and coin storage case is formed beside an article storage chamber which stores articles such as capsules. It is the third object of the present invention to provide an article retrieval equipment in which a controlling opening through which the power transmission means can be controlled and the coin storage case can be pulled out, and an access opening through which the articles are unloaded and loaded from and in the article storage chamber are closed with one lid member, so that only one key suffices, leading to easy management.

It is the fourth object of the present invention to provide an article retrieval equipment in which the height of the bottom wall of an article storage chamber is adjusted in accordance with the size of an article to be retrieved so the article can be transported to the falling port smoothly, to prevent a plurality of articles from falling to the falling port simultaneously.

It is the fifth object of the present invention to provide an article retrieval equipment in which a falling position where an article falls onto a falling passage from a falling port is set spaced apart from an opening/closing door so the falling article can be speeded. Thus, cases wherein a small, lightweight article is undesirably stopped by the opening/closing door can decrease.

It is the sixth object of the present invention to provide an article retrieval equipment in which a display which displays the price, contents, and the like of the article is covered with a transparent cover body to prevent the display from being changed accidentally.

DISCLOSURE OF INVENTION

In order to achieve the first object, an article retrieval equipment according to claim 1 of the present invention has the following arrangement.

There is provided an article retrieval equipment wherein (a) an equipment body has an article storage chamber which stores an article and a control room which stores a coin selector, (b) a bottom wall of the article storage chamber is provided with a pivotal rotary disk having an accommodation hole to accommodate the article and has a falling port which opposes the accommodation hole of the rotary disk, (c) the equipment body is provided with a falling passage which communicates with an article outlet opposing the falling port of the article storage chamber and formed in a lower portion of the equipment body, (d) the equipment body is provided with an operation part which rotates the rotary disk through power transmission means to oppose the accommodation hole to the falling port and allows the article accommodated in the accommodation hole to fall into the article outlet through the falling port and falling passage, (e) the coin selector renders one of the rotary disk and power transmission means rotatable with a coin inserted through a coin inlet and is provided with a coin storage case thereunder, (f) the article outlet, operation part, and coin inlet are formed on a front surface of the equipment body, and (g) a controlling opening through which the coin storage case can be pulled out and a lid member which opens and closes the controlling opening are provided to a rear surface of the equipment body.

In order to achieve the first object, an article retrieval equipment according to claim 2 of the present invention has the following arrangement.

There is provided an article retrieval equipment wherein (a) an equipment body has an article storage chamber which stores an article and a control room which stores power transmission means, (b) a bottom wall of the article storage chamber is provided with a pivotal rotary disk having an accommodation hole to accommodate the article and has a falling port which opposes the accommodation hole of the rotary disk, (c) the equipment body is provided with a falling passage which communicates with an article outlet opposing the falling port of the article storage chamber and formed in a lower portion of the equipment body, (d) the equipment body is provided with an operation part which rotates the rotary disk through the power transmission means to oppose the accommodation hole to the falling port and allows the article stored in the accommodation hole to fall into the article outlet through the falling port and falling passage, (e) the article outlet, the operation part, and a coin inlet are formed on a front surface of the equipment body, and (f) a controlling opening through which the power transmission means can be controlled and a lid member which opens and closes the controlling opening are provided to a rear surface of the equipment body.

In order to achieve the first object, an article retrieval equipment according to claim 3 of the present invention has the following arrangement.

There is provided an article retrieval equipment wherein (a) an equipment body has an article storage chamber which stores an article and a control room which stores power transmission means and a coin selector, (b) a bottom wall of the article storage chamber is provided with a pivotal rotary disk having an accommodation hole to accommodate the article and has a falling port which opposes the accommodation hole of the rotary disk, (c) the equipment body is provided with a falling passage which communicates with an article outlet opposing the falling port of the article storage chamber and formed in a lower portion of the equipment body, (d) the equipment body is provided with an operation part which rotates the rotary disk through the power transmission means to oppose the accommodation hole to the falling port and allows the article accommodated in the accommodation hole to fall into the article outlet through the falling port and falling passage, (e) the coin selector renders one of the rotary disk and power transmission means rotatable with a coin inserted through a coin inlet and is provided with a coin storage case thereunder, (f) the article outlet, operation part, and coin inlet are formed on a front surface of the equipment body, and (g) a controlling opening through which the power transmission means can be controlled and the coin storage case can be pulled out and a lid member which opens and closes the controlling opening are provided to a rear surface of the equipment body.

In order to achieve the first object, an article retrieval equipment according to claim 4 of the present invention is configured that the lid member opens and closes the access opening, which is formed in the article storage chamber and though which the article is unloaded and loaded, as well as the controlling opening.

In order to achieve the second object, an article retrieval equipment according to claim 5 of the present invention has the following arrangement.

There is provided an article retrieval equipment wherein (a) an equipment body has an article storage chamber which stores an article and a control room which stores a coin selector, (b) a bottom wall of the article storage chamber is provided with a pivotal rotary disk having an accommodation hole to accommodate the article and has a falling port which opposes the accommodation hole of the rotary disk, (c) the equipment body is provided with a falling passage which communicates with an article outlet opposing the falling port of the article storage chamber and formed in a lower portion of the equipment body, (d) the equipment body is provided with an operation part which rotates the rotary disk through power transmission means to oppose the accommodation hole to the falling port and allows the article accommodated in the accommodation hole to fall into the article outlet through the falling port and falling passage, (e) the coin selector renders one of the rotary disk and power transmission means rotatable with a coin inserted through a coin inlet and is provided with a coin storage case thereunder, (f) the control room is arranged beside the article storage chamber, and (g) the article outlet, the operation part, the coin inlet, and a controlling opening through which the coin storage case can be pulled out, and a lid member which opens and closes the controlling opening are provided to the control room.

In order to achieve the second object, an article retrieval equipment according to claim 6 of the present invention has the following arrangement in addition to the above arrangement.

There is provided an article retrieval equipment wherein (a) the article outlet, operation part, and coin inlet are provided to a front portion of the control room, and (b) the controlling opening through which the coin storage case can be pulled out and a lid member which opens and closes the controlling opening are provided to a rear surface of the control room.

In order to achieve the third object, an article retrieval equipment according to claim 7 of the present invention has the following arrangement.

There is provided an article retrieval equipment wherein (a) an equipment body has first and second storage chambers, (b) the first storage chamber stores an article, is provided with a pivotal rotary disk having an accommodation hole to accommodate the article at a bottom wall thereof, and has a falling port which opposes the accommodation hole of the rotary disk in the bottom wail, (c) the second storage chamber has a falling passage which communicates with an article outlet opposing the falling port of the first storage chamber and formed in a lower portion of the equipment body, (d) the second accommodation chamber accommodates power transmission means which transmits rotation of an operation part provided to the equipment body to the rotary disk to rotate the rotary disk so as to oppose the accommodation hole to the falling port, and allows the article accommodated in the accommodation hole to fall into the article outlet through the falling port and falling passage, (e) the first storage chamber has an access opening through which the article is unloaded and loaded, and (f) the second storage chamber has a controlling opening through which the power transmission means is controlled, and the equipment body is provided with a lid member which opens and closes the access opening and controlling opening.

In order to achieve the third object, there is provided an article retrieval equipment according to claim 8 of the present invention, wherein the second storage chamber is provided with a coin selector which renders one of the rotary disk and power transmission means rotatable with a coin inserted through the coin inlet, and a coin storage case which is provided under the coin selector and can be pulled out through the controlling opening.

In order to achieve the third object, an article retrieval equipment according to claim 9 of the present invention has the following arrangement.

There is provided an article retrieval equipment wherein (a) an equipment body has an article storage chamber which stores an article and a control room which stores power transmission means, (b) a bottom wall of the article storage chamber is provided with a pivotal rotary disk having an accommodation hole to accommodate the article and has a falling port which opposes the accommodation hole of the rotary disk, (c) the equipment body is provided with a falling passage which communicates with an article outlet opposing the falling port of the article storage chamber and formed in a lower portion of the equipment body, (d) the equipment body is provided with an operation part which rotates the rotary disk through the power transmission means to oppose the accommodation hole to the falling port and allows the article accommodated in the accommodation hole to fall into the article outlet through the falling port and falling passage, (e) the article storage chamber has an access opening through which the article is unloaded and loaded, (f) the control room has a controlling opening through which the power transmission means is controlled, and (g) the equipment body is provided with a lid member which opens and closes the access opening and controlling opening.

In order to achieve the third object, an article retrieval equipment according to claim 10 of the present invention has the following arrangement.

There is provided an article retrieval equipment wherein (a) an equipment body has an article storage chamber which stores an article and a control room which stores a coin selector, (b) a bottom wall of the article storage chamber is provided with a pivotal rotary disk having an accommodation hole to accommodate the article and has a falling port which opposes the accommodation hole of the rotary disk, (c) the equipment body is provided with a falling passage which communicates with an article outlet opposing the falling port of the article storage chamber and formed in a lower portion of the equipment body, (d) the equipment body is provided with an operation part which rotates the rotary disk through power transmission means to oppose the accommodation hole to the falling port and allows the article accommodated in the accommodation hole to fall into the article outlet through the falling port and falling passage, (e) the coin selector renders one of the rotary disk and power transmission means rotatable with a coin inserted through a coin inlet and is provided with a coin storage case thereunder, (f) the article storage chamber has an access opening through which the article is unloaded and loaded, (g) the control room has a controlling opening through which the coin storage case can be pulled out, and (h) the equipment body is provided with a lid member which opens and closes the access opening and controlling opening.

In order to achieve the third object, an article retrieval equipment according to claim 11 of the present invention has the following arrangement.

There is provided an article retrieval equipment wherein (a) an equipment body has an article storage chamber which stores an article and a control room which stores power transmission means and a coin selector, (b) a bottom wall of the article storage chamber is provided with a pivotal rotary disk having an accommodation hole to accommodate the article and has a falling port which opposes the accommodation hole of the rotary disk, (c) the equipment body is provided with a falling passage which communicates with an article outlet opposing the falling port of the article storage chamber and formed in a lower portion of the equipment body, (d) the equipment body is provided with an operation part which rotates the rotary disk through the power transmission means to oppose the accommodation hole to the falling port and allows the article accommodated in the accommodation hole to fall into the article outlet through the falling port and falling passage, (e) the coin selector renders one of the rotary disk and power transmission means rotatable with a coin inserted through a coin inlet and is provided with a coin storage case thereunder, (f) the article storage chamber has an access opening through which the article is unloaded and loaded, (g) the control room has a controlling opening through which the power transmission means is controlled and the coin storage case can be pulled out, and (h) the equipment body is provided with a lid member which opens and closes the access opening and controlling opening.

In order to achieve the third object, there is provided an article retrieval equipment according to claim 12 of the present invention, wherein the equipment body is provided with lock means for unrotatably locking the rotary disk when the lid member is opened and rotatably unlocking the rotary disk when the lid member is closed.

In order to achieve the foregoing objects, an article retrieval equipment is provided wherein (a) an equipment body has an article storage chamber which stores an article, (b) a bottom wall of the article storage chamber is provided with a pivotal rotary disk having an accommodation hole to accommodate the article and has a falling port which opposes the accommodation hole of the rotary disk, (c) the equipment body is provided with a falling passage which communicates with an article outlet opposing the falling port of the article storage chamber and formed in a lower portion of the equipment body, (d) the equipment body is provided with an operation part which rotates the rotary disk to oppose the accommodation hole to the falling port and allows the article accommodated in the accommodation hole to fall into the article outlet through the falling port and falling passage, and (e) the bottom wall is provided with height adjusting means for allowing to adjust a position in a direction of height of the article accommodated in the accommodation hole of the rotary disk.

In order to further achieve the objects, there is provided an article retrieval equipment wherein the height adjusting means comprises a guide member provided in a recess formed in the bottom wall.

In order to achieve the objects, there is provided an article retrieval equipment wherein the guide member has an operation part projecting from an elongated groove formed in one side of the article storage chamber, and serves to move upward along an inclined projection formed on the recess of the bottom wall when operated in one direction by the operation part and move downward along the inclined projection when operated in the other direction by the operation part.

In order to achieve another object, an article retrieval equipment has the following arrangement in addition to the above arrangement.

There is provided an article retrieval equipment wherein (a) an equipment body has an article storage chamber which stores an article, (b) a bottom wall of the article storage chamber is provided with a pivotal rotary disk having an accommodation hole to accommodate the article and has a falling port which opposes the accommodation hole of the rotary disk, (c) the equipment body is provided with a falling passage which communicates with an article outlet opposing the falling port of the article storage chamber and formed in a lower portion of the equipment body, (d) the equipment body is provided with an operation part which rotates the rotary disk to oppose the accommodation hole to the falling port and allows the article accommodated in the accommodation hole to fall into the article outlet through the falling port and falling passage, (e) the bottom wall is provided with height adjusting means for allowing to adjust a position in a direction of height of the article accommodated in the accommodation hole of the rotary disk, and (f) the bottom wall is provided with fall adjusting means for allowing to adjust a falling position of the article which falls from the falling port.

In order to achieve the fifth object, an article retrieval equipment according to claim 17 of the present invention has the following arrangement in addition to the above arrangement.

There is provided an article retrieval equipment wherein (a) the fall adjusting means comprises a guide member provided to the bottom wall, and (b) the guide member has an operation part projecting from an elongated groove formed in one side of the article storage chamber, and serves to narrow the falling port, when operated in one direction by the operation part, to set a falling position of the article at a position spaced apart from the article outlet, and enlarge the falling port when operated in the other direction by the operation part.

In order to achieve the fourth and fifth objects, an article retrieval equipment according to claim 18 of the present invention has the following arrangement.

There is provided an article retrieval equipment wherein (a) an equipment body has an article storage chamber which stores an article, (b) a bottom wall of the article storage chamber is provided with a pivotal rotary disk having an accommodation hole to accommodate the article and has a falling port which opposes the accommodation hole of the rotary disk, (c) the equipment body is provided with a falling passage which communicates with an article outlet opposing the falling port of the article storage chamber and formed in a lower portion of the equipment body, (d) the equipment body is provided with an operation part which rotates the rotary disk to oppose the accommodation hole to the falling port and allows the article accommodated in the accommodation hole to fall into the article outlet through the falling port and falling passage, and (e) the bottom wall is provided with adjusting means for allowing to adjust a position in a direction of height of the article accommodated in the accommodation hole of the rotary disk and a falling position of the article which falls from the falling port.

In order to achieve the fourth and fifth objects, an article retrieval equipment according to claim 19 of the present invention has the following arrangement.

There is provided an article retrieval equipment wherein (a) the adjusting means comprises a guide member provided to a recess formed in the bottom wall, and (b) the guide member has an operation part projecting from an elongated groove formed in one side of the article storage chamber, and serves to move upward along an inclined projection formed on the recess of the bottom wall, when operated in one direction by the operation part, to narrow the falling port to set a falling position of the article at a position spaced apart from the article outlet, and move downward along the inclined projection, when operated in the other direction by the operation part, to enlarge the falling port.

In order to achieve the sixth object, an article retrieval equipment according to claim 20 of the present invention has the following arrangement.

There is provided an article retrieval equipment wherein (a) an equipment body has an article storage chamber which stores an article and a control room which stores a coin selector, (b) a bottom wall of the article storage chamber is provided with a pivotal rotary disk having an accommodation hole to accommodate the article and has a falling port which opposes the accommodation hole of the rotary disk, (c) the equipment body is provided with a falling passage which communicates with an article outlet opposing the falling port of the article storage chamber and formed in a lower portion of the equipment body, (d) the equipment body is provided with an operation part which rotates the rotary disk through power transmission means to oppose the accommodation hole to the falling port and allows the article accommodated in the accommodation hole to fall into the article outlet through the falling port and falling passage, (e) the coin selector renders one of the rotary disk and power transmission means rotatable with a coin inserted through a coin inlet and is provided with a coin storage case thereunder, (f) the equipment body is provided with a display which displays a price and content of the article, the number of coins to be inserted, and the like, and a pivotal cover member which can cover the display and is made of a transparent material, and (g) the cover member is fixed by the coin selector, and serves to be fixed, when the coin selector is stored, to cover the display, and be disengaged, when the coin selector is removed, and allowed to pivot to expose the display.

In order to achieve the sixth object, an article retrieval equipment according to claim 21 of the present invention has the following arrangement in addition to the above arrangement.

There is provided an article retrieval equipment wherein (a) the display is provided to a rotary cylindrical portion which is pivotally provided to the equipment body and partly exposes from an opening formed in the equipment body, and (b) the cover member is formed to cover part of the rotary cylindrical portion exposing from the opening of the equipment body, is provided with an engaging member at one side thereof, and is fixed to cover part of the rotary cylindrical portion when the engaging member engages with the coin selector which is being stored.

In order to achieve the first object, an article retrieval equipment according to claim 22 of the present invention has the following arrangement.

There is provided an article retrieval equipment comprising:

(a) an equipment body;

(b) an article accommodation chamber which is provided to the equipment body and capable of accommodating an article;

(c) a coin slot which is formed in the equipment body and through which a coin can be loaded from a front surface of the equipment body;

(d) an operation part which is provided to the equipment body and becomes operative after a coin is inserted through the coin slot;

(e) guide means, provided to the equipment body, for guiding the article accommodated in the article accommodation chamber to outside the equipment body in response to operation of the operation part; and (f) a coin storage case which can accommodate a coin loaded through the coin slot and can be accessed from a rear surface of the equipment body.

In order to achieve the first object, there is provided an article retrieval equipment according to claim 23 of the present invention, wherein the operation part can be operated from a front surface of the equipment body.

In order to achieve the first object, there is provided an article retrieval equipment according to claim 24 of the present invention, wherein the article accommodation chamber has an article loading port through which an article can be loaded from a rear surface of the equipment body.

In order to achieve the first object, there is provided an article retrieval equipment according to claim 25 of the present invention, wherein the coin storage case is arranged in the equipment body, the equipment body has a prohibition door which prohibits access to the coin storage case from a rear surface of the equipment body, and the prohibition door forms a rear-side outer wall of the equipment body.

In order to achieve the first object, an article retrieval equipment according to claim 26 of the present invention has the following arrangement in addition to the above arrangement.

There is provided an article retrieval equipment wherein (a) the article accommodation chamber has an article loading port through which an article can be loaded from a rear surface of the equipment body, (b) the coin storage case is arranged in the equipment body, and (c) the equipment body has a prohibition door which prohibits access to the coin storage case from a rear surface of the equipment body and loading of an article from the article loading port.

In order to achieve the first object, there is provided an article retrieval equipment according to claim 27 of the present invention, wherein the operation part can be operated from a front surface of the equipment body.

In order to achieve the first object, an article retrieval equipment according to claim 28 of the present invention has the following arrangement in addition to the above arrangement.

There is provided an article retrieval equipment comprising:

(a) an equipment body;

(b) an article accommodation chamber which is provided to the equipment body and capable of accommodating an article;

(c) a rotary disk which is pivotally provided to a bottom wall of the article accommodation chamber and has an accommodation hole to accommodate an article;

(d) a falling port which is formed in the bottom wall of the article accommodation chamber and capable of opposing the accommodation hole of the rotary disk;

(e) a coin slot which is formed in the equipment body and located beside the article accommodation chamber;

(f) a coin storage case which is arranged in the equipment body and located beside the article accommodation chamber and under the coin slot;

(g) coin detection means, arranged between the coin slot and coin storage case, for detecting that a coin is loaded from the coin slot;

(h) an operation part which is located between the rotary disk and coin detection means and becomes operative after a coin is detected by the coin detection means; and (i) power transmission means provided to the equipment body and capable of rotating the rotary disk so as to oppose the accommodation hole to the falling port and allow the article accommodated in the accommodation hole to fall from the falling port in accordance with operation of the operation part.

BEST MODE FOR CARRYING OUT THE INVENTION

Figure 1:
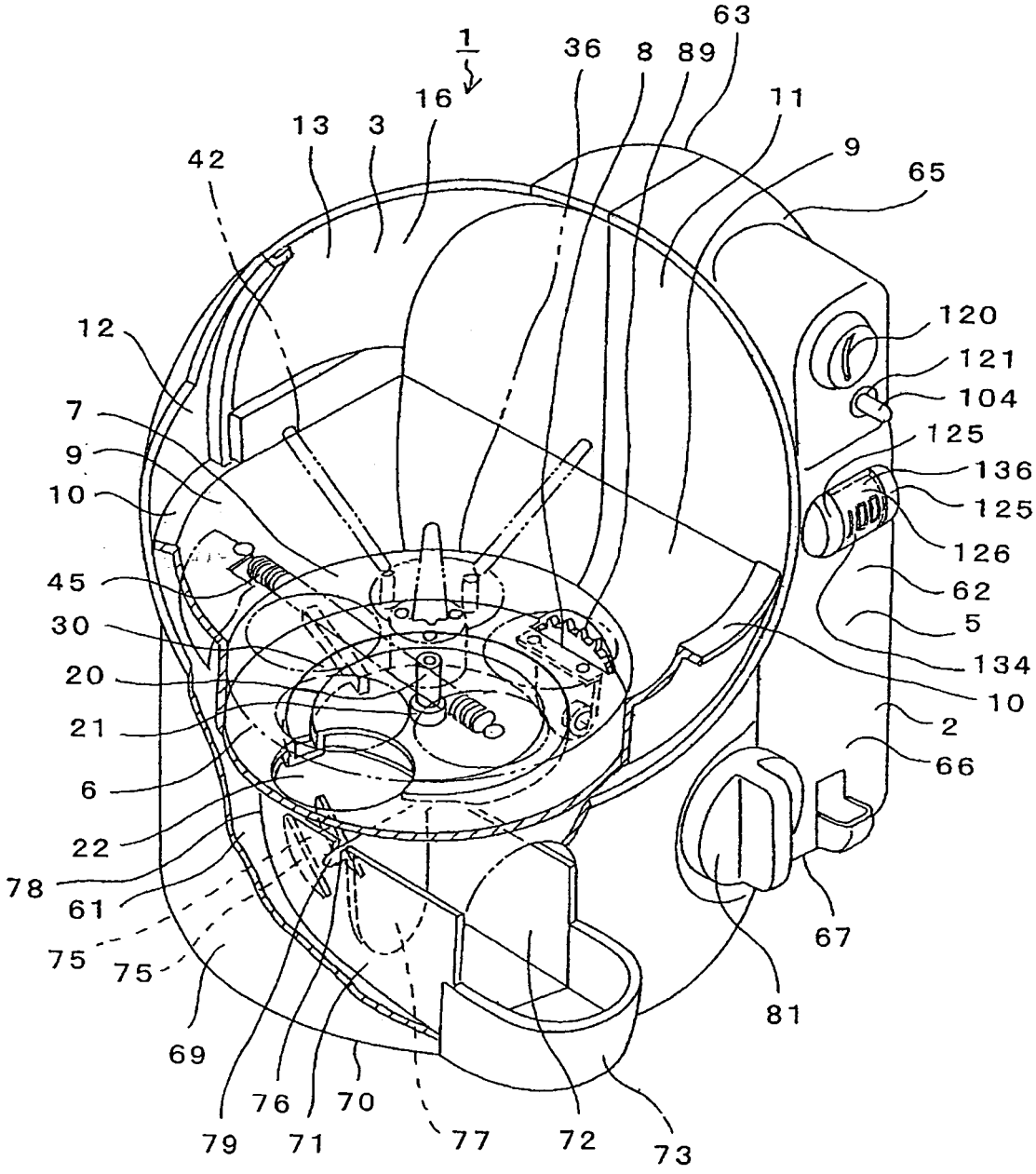
FIG. 1 is an overall perspective view, seen from the front side, of an article retrieval equipment according to one embodiment of the present invention.
Figure 2:
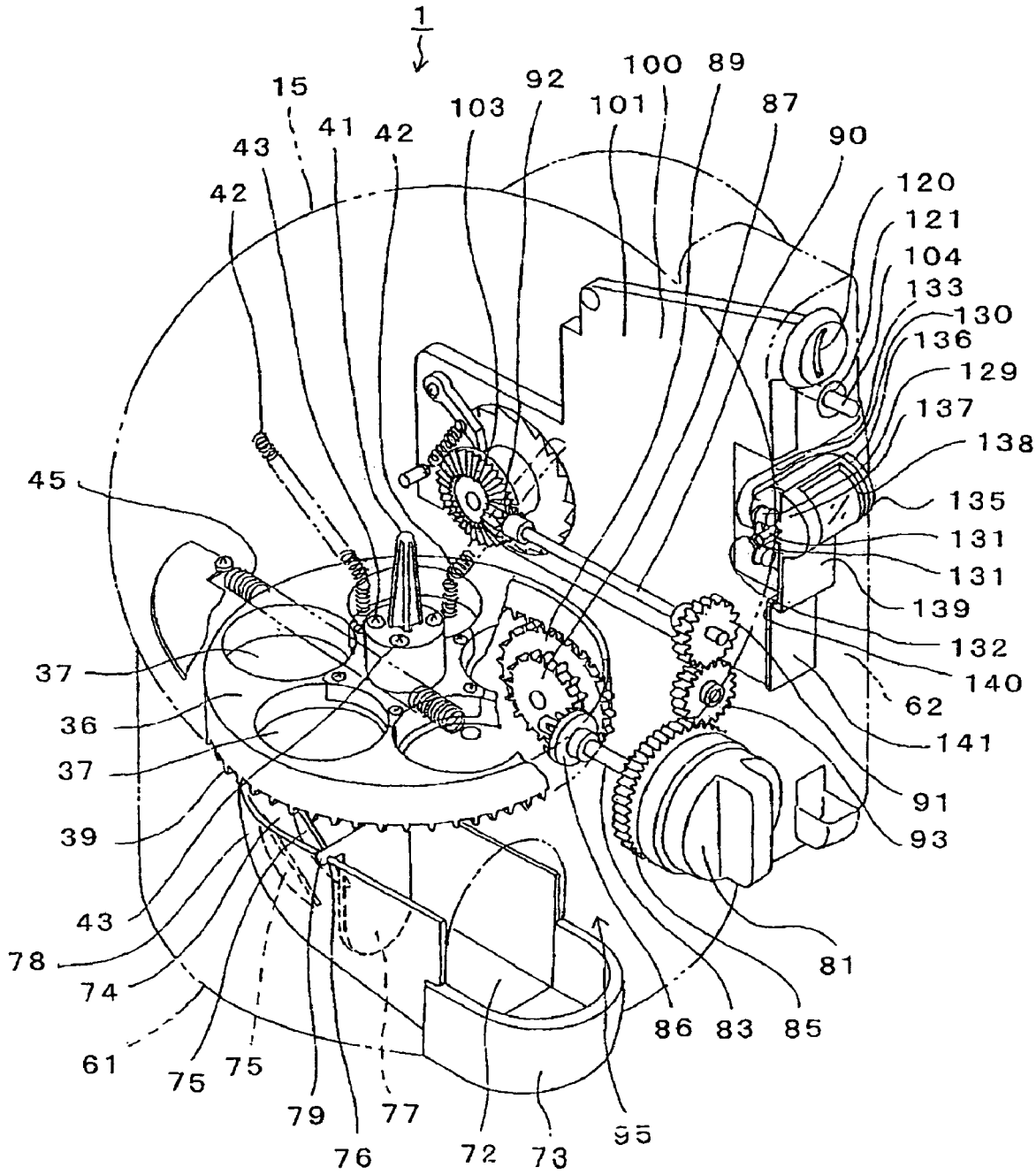
FIG. 2 is a partial perspective view of FIG. 1.
Figure 3:
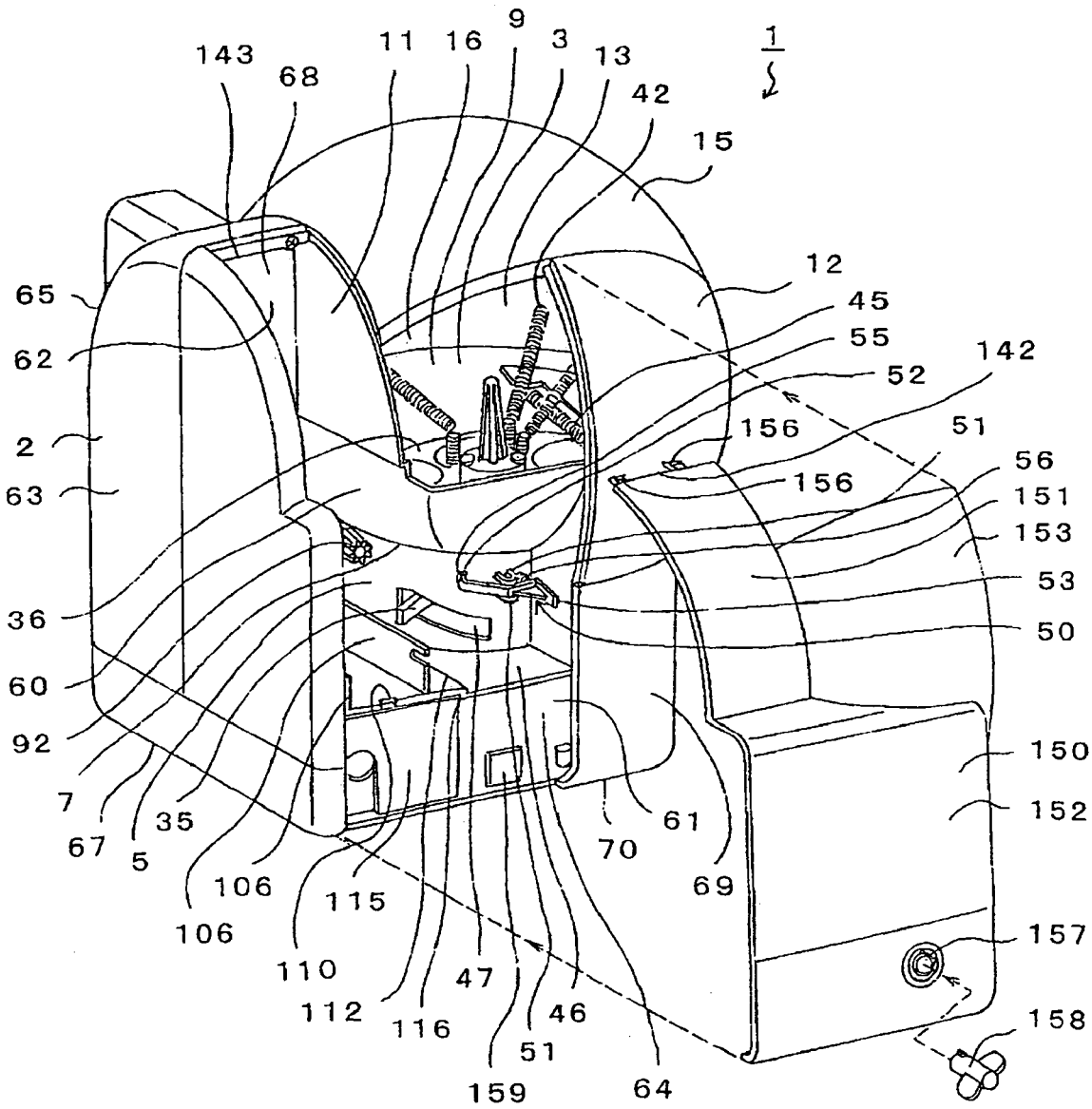
FIG. 3 is an overall perspective view seen from the rear side of FIG. 1.
Figure 4A:
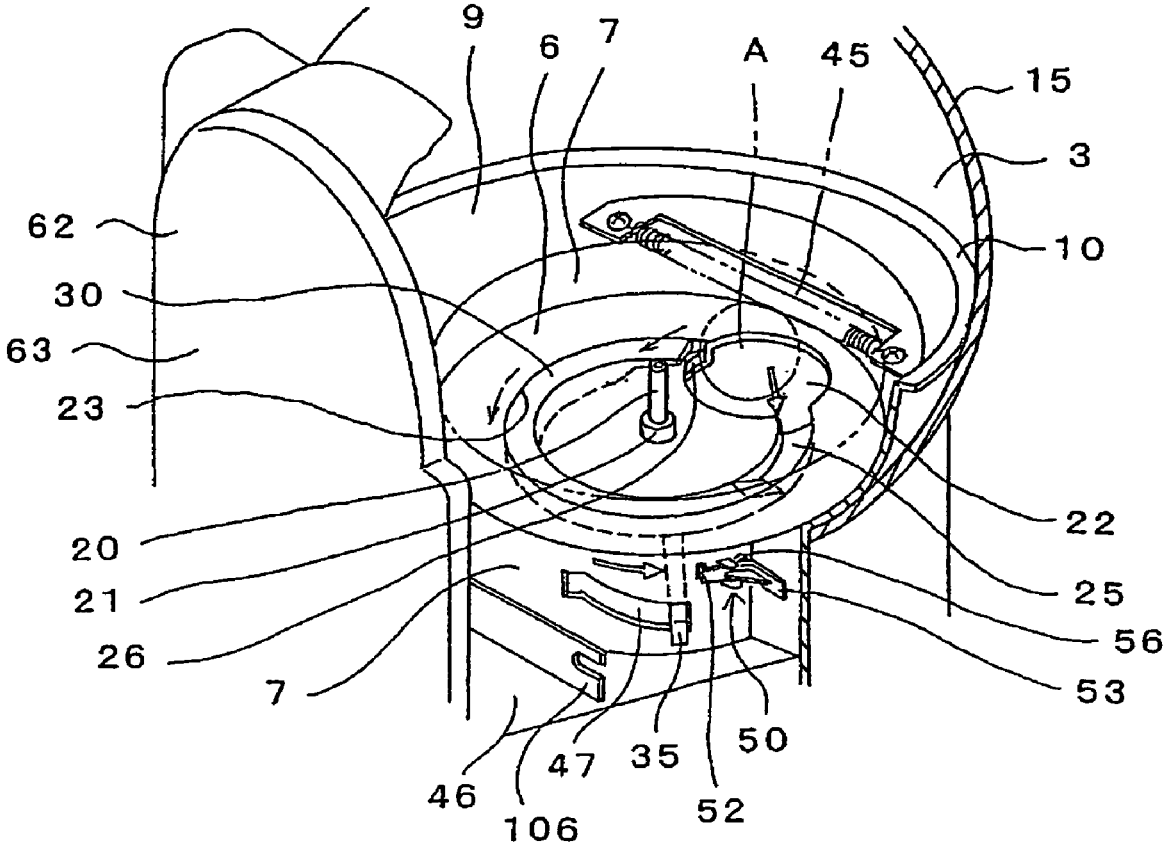
FIGS. 4A and 4B include views for explaining the operation of a height adjusting means.
Figure 4B:
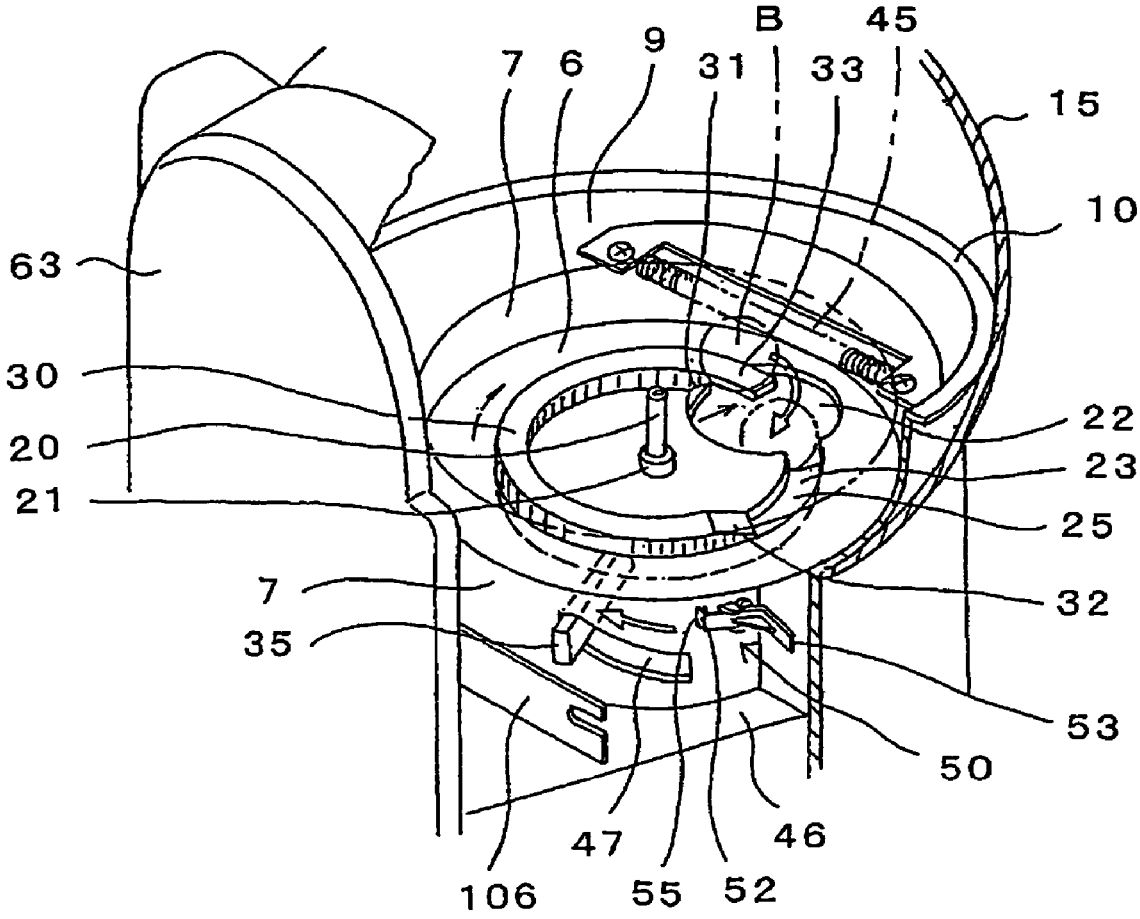
Figure 5:
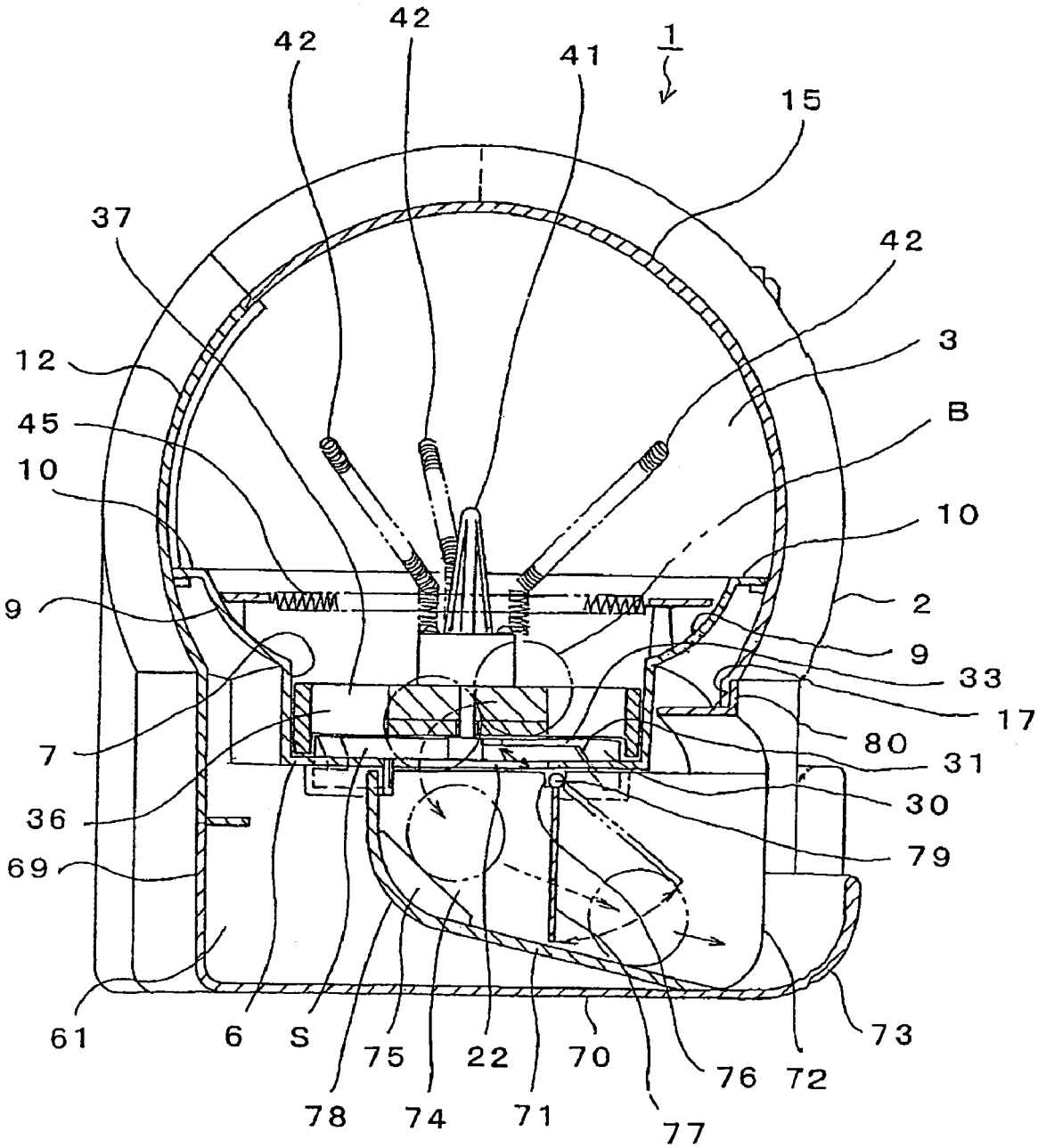
FIG. 5 is a side sectional view for explaining the operation of a falling position adjusting means.
Figure 6:
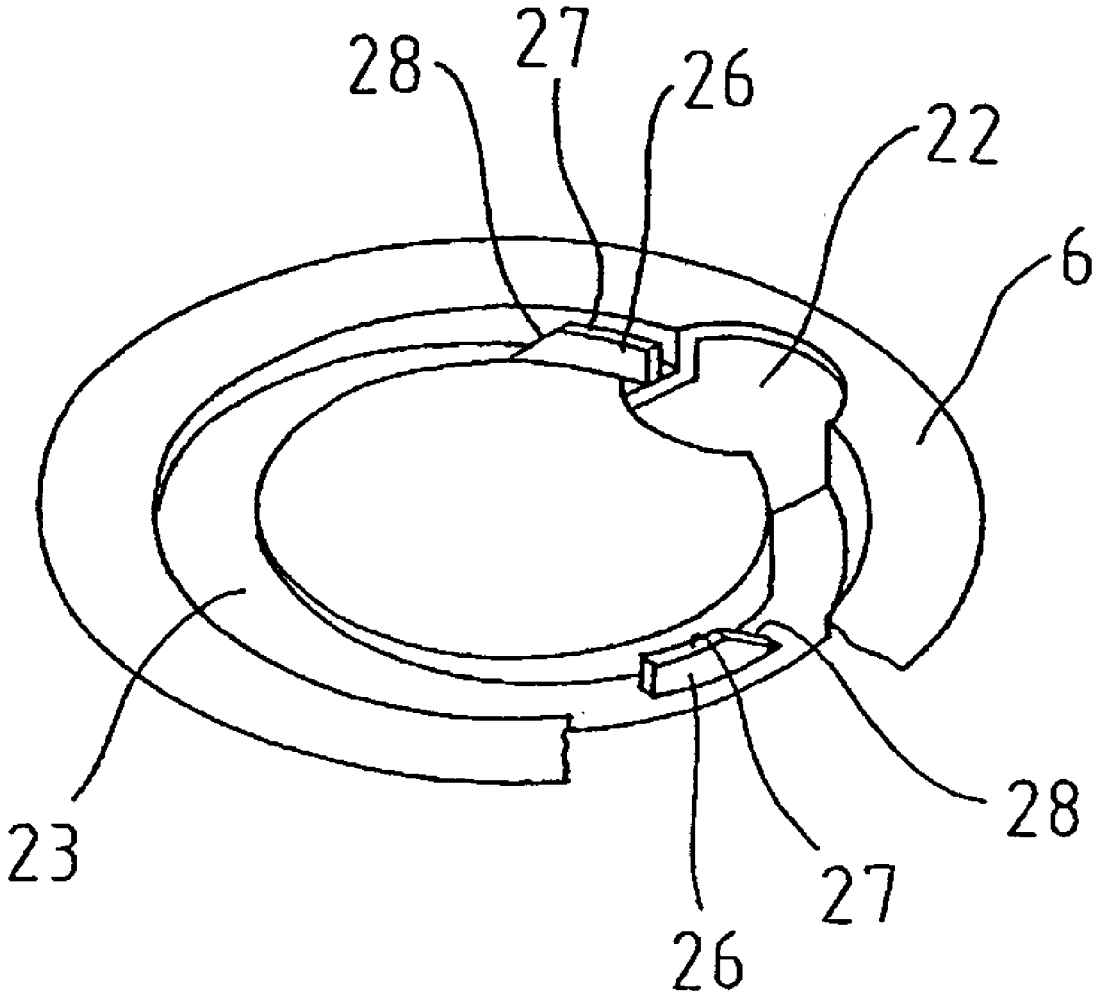
FIG. 6 is a view for explaining the main part of FIGS. 4A and 4B.
Figure 7A:
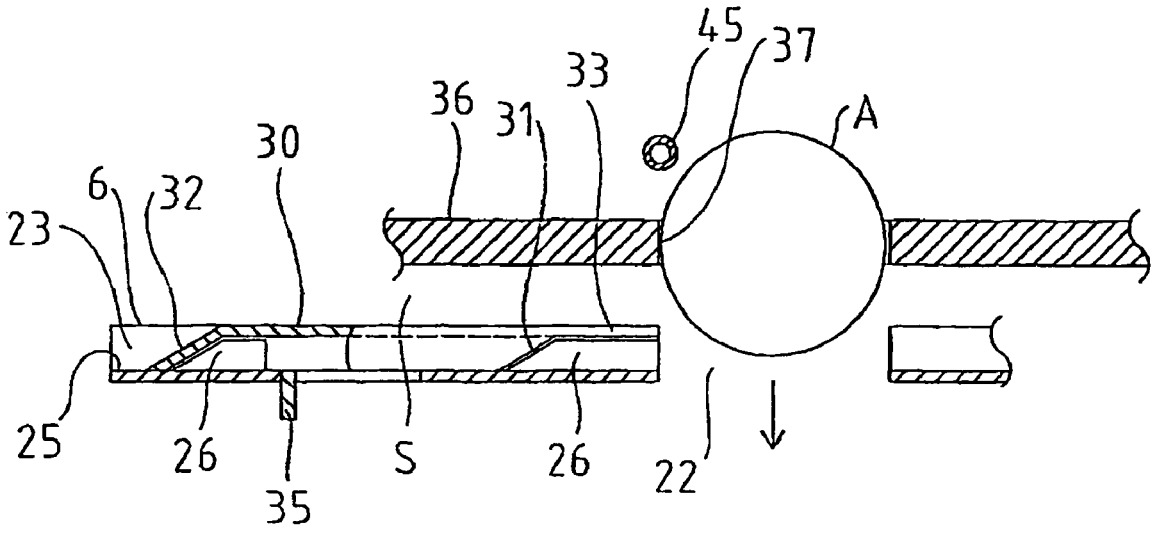
FIGS. 7A and 7B include views for explaining FIG. 5.

An article retrieval equipment according to an embodiment of the present invention will be described with reference to the accompanying drawings. FIG. 1 is an overall perspective view, seen from the front side, of an article retrieval equipment according to one embodiment of the present invention. FIG. 2 is a partial perspective view of FIG. 1. FIG. 3 is an overall perspective view seen from the rear side of FIG. 1. FIGS. 4A and 4B include views for explaining the operation of a height adjusting means. FIG. 5 is a side sectional view for explaining the operation of a falling position adjusting means. FIG. 6 is a view for explaining the main part of FIGS. 4A and 4B FIGS. 7A and 7B include views for explaining FIG. 5. FIG. 8 is a side sectional view for explaining a transparent cover for a price display.

An equipment body 2 of an article retrieval equipment 1 has an article storage chamber 3 (first storage chamber) for storing articles A and B and a control room 5 (second storage chamber) for storing a power transmission means 95 and coin selector 100. A rotary disk 36 having accommodation holes 37 to store the articles A and B is pivotally arranged on a bottom wall 6 of the article storage chamber 3. A falling port 22 which opposes the accommodation holes 37 of the rotary disk 36 is also formed in the bottom wall 6 of the article storage chamber 3. The equipment body 2 has a falling passage 71 which communicates with an article outlet 72 opposing the falling port 22 of the article storage chamber 3 and formed in the lower portion of the equipment body 2.

An operation part 81 is provided to the equipment body 2. The operation part 81 rotates the rotary disk 36 through the power transmission means 95 to oppose the accommodation holes 37 to the falling port 22, so that the articles A and B stored in the accommodation holes 37 fall to the article outlet 72 through the falling port 22 and falling passage 71. The coin selector 100 causes a coin inserted from a coin inlet 102 to rotate the rotary disk 36 or power transmission means 95. The coin selector 100 has a coin storage case 115 in its lower portion.

The control room 5 is formed beside the article storage chamber 3. The article outlet 72, operation part 81, and coin inlet 102 are formed on the front surface of the equipment body 2, i.e., the front surface of the control room 5. A controlling opening 60, through which the power transmission means 95 can be controlled and the coin storage case 115 can be pulled out, is formed on the rear surface of the equipment body 2, i.e., the rear surface of the control room 5. The article storage chamber 3 has an access opening 16 through which the articles A and B are unloaded and loaded. A lid member 150 which opens and closes the access opening 16 and controlling opening 60 is provided to the rear surface of the equipment body 2.

The equipment body 2 is provided with a lock means 50. When the lid member 150 is opened, the lock means 50 unrotatably locks the rotary disk 36. When the lid member 150 is closed, the lock means 50 rotatably unlocks the rotary disk 36. The bottom wall 6 is provided with an adjusting means 30 (height adjusting means or fall adjusting means) which can adjust the positions in the direction of height of the articles A and B stored in the accommodation holes 37 of the rotary disk 36 and the falling positions of the articles A and B falling from the falling port 22. The adjusting means (height adjusting means or fall adjusting means) comprises a guide member 30 which is arranged in a recess 23 formed in the bottom wall 6.

The guide member 30 has an operation member 35 projecting from an elongated groove 47 formed in one side of the article storage chamber 3. When the guide member 30 is operated in one direction by the operation member 35, the guide member 30 moves upward along inclined projections 26 formed on the recess 23 of the bottom wall 6 and narrows the falling port 22 to set the falling position of the articles A and B at a position spaced apart from the article outlet 72. When the guide member 30 is operated in the other direction by the operation member 35, the guide member 30 moves downward along the inclined projections 26 to enlarge the falling port 22.

The equipment body 2 has displays 134 which display the price and content of an article, the number or inserted coins, and the like. A cover member 135 capable of covering the displays 134 and made of a transparent material is pivotally provided to the equipment body 2. The displays 134 are arranged on a rotary cylindrical portion 130 which is pivotally provided to the equipment body 2 and part of which exposes through an opening 126 formed in the equipment body 2.

The cover member 135 is formed to be able to cover part of the rotary cylindrical portion 130 exposing from the opening 126 of the equipment body 2, and has an engaging member 139 on its one side. When the engaging member 139 engages with the coin selector 100 which is being stored, the cover member 135 is fixed as it covers the displays 134 of the rotary cylindrical portion 130. When the coin selector 100 is to be removed, the cover member 135 is released and pivoted to expose the displays 134.

More specifically, the article retrieval equipment 1 comprises the equipment body 2, the article storage chamber 3, a coin slot 120, the operation part 81, the guide means 36, and the coin storage case 115. The article storage chamber 3 is formed in the equipment body 2 and can store the articles A. The coin slot 120 is formed in the equipment body 2. Coins can be inserted through the coin slot 120 from the front side of the equipment body 2. The operation part 81 is formed on the equipment body 2 and becomes operative after coins are inserted through the coin slot 120. The guide means 36 is provided to the equipment body 2 and guides the articles A stored in the article storage chamber 3 to outside the equipment body 2 upon operation of the operation part 81. The coin storage case 115 can store coins inserted through the coin slot 120 and can be accessed from the rear side of the equipment body 2.

The operation part 81 can be operated from the front side of the equipment body 2. The article storage chamber 3 has the article loading port 16 through which articles can be loaded from the rear side of the equipment body 2. The coin storage case 115 is arranged in the equipment body 2. The equipment body 2 has the prohibition door 150 which prohibits access to the coin storage case 115 from the rear side of the equipment body 2. The prohibition door 150 forms the rear-side outer wall of the equipment body 2.

The article storage chamber 3 has the article loading port 16 through which articles can be loaded from the rear side of the equipment body 2. The coin storage case 115 is arranged in the equipment body 2. The equipment body 2 has the prohibition door 150 which prohibits access to the coin storage case 115 from the rear side of the equipment body 2 and loading of the articles A through the article loading port 16.

The article retrieval equipment 1 comprises the equipment body 2, article storage chamber 3, rotary disk 36, falling port 22, coin slot 120, coin storage case 115, coin detection means 100, operation part 81, and power transmission means 95. The article storage chamber 3 is formed in the equipment body 2 and can store the articles A. The rotary disk 36 is pivotally arranged on the bottom wall 6 of the article storage chamber 3 and has the accommodation holes 37 to store the articles A. The falling port 22 is formed in the bottom wall 6 of the article storage chamber 3 and can oppose the accommodation holes 37 of the rotary disk 36. The coin slot 120 is formed in the equipment body 2 and located beside the article storage chamber 3. The coin storage case 115 is arranged in the equipment body 2 and located beside the article storage chamber 3 and under the coin slot 120. The coin detection means 100 is arranged between the coin slot 120 and coin storage case 115 and can detect that a coin is inserted through the coin slot 120. The operation part 81 is located between the rotary disk 36 and coin detection means 100 and becomes operative after the coin selector 100 detects a coin. The power transmission means 95 is arranged in the equipment body 2 and can rotate the rotary disk 36, in response to the operation of the operation part 81, to oppose the accommodation holes 37 to the falling port 22, so the articles A stored in the accommodation holes 37 fall through the falling port 22.

The article retrieval equipment will be described in more detail. The article retrieval equipment 1 has the equipment body 2. The equipment body 2 has the article storage chamber 3 for storing the articles A and B, and the control room 5 for storing the power transmission means 95 and coin selector 100. The article storage chamber 3 is formed of the circular bottom wall 6, a guide wall 7 formed around the bottom wall 6, an inclined wall 9 continuous to the periphery of the guide wall 7, a projecting edge 10 formed on the periphery of the inclined wall 9, a vertical wall 11 formed on the right side of the inclined wall 9, and a substantially spherical rear wall 12 formed behind the projecting edge 10. A substantially U-shaped recess 13 is formed between the vertical wall 11 and rear wall 12, that is, on the rear side of the equipment body 2.

The article storage chamber 3 also has a dome-like cover body 15 made of a transparent material. The cover body 15 is fixed as it is locked by the upper ends of the vertical wall 11 and rear wall 12 and engaged by an engaging edge 80 which is formed on a circumferential wall 69 of the control room 5 to surround the projecting edge 10. Therefore, the article storage chamber 3 is formed of the bottom wall 6, guide wall 7, inclined wall 9, vertical wall 11, rear wall 12, and cover body 15 into a sealed shape. The recess 13 forms the substantially rectangular access opening 16, on the rear side of the equipment body 2, through which the articles A and B such as capsules are loaded and unloaded.

A support shaft 20 is arranged at substantially the center of the bottom wall 6. A flange 21 is formed on the lower portion of the support shaft 20. The bottom wall 6 has the falling port 22 through which the articles are let to fall. The bottom wall 6 also has the annular recess 23 about the support shaft 20 as the center. The recess 23 has a substantially U-shaped section, and its two ends communicate with the substantial center of the falling port 22. The pair of inclined projections 26 are formed on a bottom portion 25 of the recess 23. Each inclined projection 26 has a plate-like shape and is formed of a horizontal portion 27 and inclined portion 28. The inclined projections 26 are formed in the vicinity of the falling port 22.

The substantially C-shaped guide member 30 is arranged in the recess 23. The guide member 30 serves as the height adjusting means which can adjust the positions in the direction of height of the articles A and B. The guide member 30 has a substantially U-shaped section and is formed with inclined walls 31 and 32 at its front and rear portions, so that the inclined projections 26 are inserted in the guide member 30. The guide member 30 has a guide projection 33 which is substantially identical with the upper wall. The guide projection 33 can retract into the falling port 22. The guide member 30 is provided with the operation member 35 at its lower portion. The operation member 35 projects from the elongated groove 47 formed in the guide wall 7.

The rotary disk 36 is pivotally provided to the bottom wall 6 through the support shaft 20 projecting from the bottom wall 6. The rotary disk 36 is placed on the flange 21 to form a space S together with the bottom wall 6. The accommodation holes 37 which can respectively store the articles A and B, e.g., capsules containing small toys, are formed in the peripheral portion of the rotary disk 36 about the support shaft 20 as the center at a predetermined interval. An annular rack 39 is formed on the periphery of the lower surface of the rotary disk 36. When the rotary disk 36 rotates, the plurality of accommodation holes 37 formed in the peripheral portion of the rotary disk 36 oppose the falling port 22 sequentially.

A substantially circular conical article distribution shaft 41 projects from substantially the center of the rotary disk 36. Bent stirring springs 42 are attached around the article distribution shaft 41 with screws 43. On the inclined wall 9 of the article storage chamber 3, a preventive spring 45 is provided substantially immediately above the falling port 22 to allow the articles A and B to be stored in the respective accommodation holes 37. If two or more articles A and B are stored in one accommodation hole 37, the preventive spring 45 expels the excessive articles from the accommodation hole 37. This prevents two articles A and B from consecutively falling into the falling port 22.

A partition wall 46 extends outwardly from the periphery of the lower end of the guide wall 7 of the article storage chamber 3 horizontally. The partition wall 46 vertically partitions the control room 5 provided on the left of and under the article storage chamber 3. The guide wall 7 has the elongated groove 47 through which the operation member 35 projects into the control room 5. A pair of bearing portions 51 are formed on the guide wall 7 side by side in the longitudinal direction. The bearing portions 51 hold the lock means 50 to be horizontally pivotal.

The lock means 50 has a locking projection 52 at its distal end and an operation piece 53 at its rear end. The lock means 50 is pivotally supported substantially at its central portion by the pair of bearing portions 51. The locking projection 52 of the lock means 50 is inserted in an opening 55 formed in the guide wall 7 to lock the rack 39 of the rotary disk 36. The lock means 50 is biased by an elastic member 56 such as a spring in such a direction that its locking projection 52 projects from the opening 55 to lock the rack 39 of the rotary disk 36.

The control room 5 has a coin selector storage 62 arranged on the right of the article storage chamber 3, and a stage portion 61 formed under the article storage chamber 3. The stage portion 61 of the control room 5 supports the article storage chamber 3. The coin selector storage 62 has a semicylindrical right-side wall 63. A front wall 65 extending from the lower end of the front portion of the right-side wall 63 leftward to the vertex of the arcuate portion of the semicylindrical shape and a lower wall 67 extending from the lower edge of the right-side wall 63 leftward are connected to the semicylindrical vertical wall 11, thus forming the coin selector storage 62.

The right-side wall 63 is open from the vertex of its semicylindrical arcuate portion to the lower end of its rear portion to form a rear opening 68 in the rear surface of the coin selector storage 62. The stage portion 61 comprises the semicylindrical circumferential wall 69 of the equipment body 2, and a lower wall 70 which extends from the lower edge of the circumferential wall 69 inwardly into the equipment body 2 to be connected to the lower wall 67 of the coin selector storage 62. The circumferential wall 69 extends to the rear end edge of the rear wall 12. The rear ends of the circumferential wall 69 and rear wall 12, the rear end of the right-side wall 63, and the lower end of the lower wall 67 form a lower opening 64 in the rear surface of the equipment body 2. The rear opening 68 and lower opening 64 form the controlling opening 60.

The lower wall 70 is formed with the falling passage 71 which opposes the falling port 22 of the article storage chamber 3. The falling passage 71 has a substantially U-shaped section, is inclined downward toward the article outlet 72 formed in the lower portion of the circumferential wall 69, and is continuous to an article accepting portion 73 formed in front of the article outlet 72.

A rear portion 74 of the falling passage 71 is located substantially immediately under the falling port 22. A pair of inclined ribs 75 are formed on an arcuate rear wall 78 of the falling passage 71, so the articles A and B fall onto the inclined ribs 75. Bearing recesses 76 are formed in the upper portion of substantially the center of the falling passage 71. A support shaft 79 of a lid body 77 is pivotally attached to the bearing recesses 76. The lid body 77 is pivotal only toward the article outlet 72 side, so a hand cannot be inserted from the article outlet 72 side. The cover body 15 is attached to the circumferential wall 69 such that a lower end 17 of the cover body 15 engages with the engaging edge 80 of the circumferential wall 69.

The disk-like operation member 81 is formed on the front surface of the equipment body 2, i.e., the front surface of the circumferential wall 69. The operation member 81 is located such that the rotary disk 36 in the article storage chamber 3, the operation member 81, and the coin selector storage 62 line up from the left in this order when the equipment body 2 is seen from the front. A rotating shaft 83 of the operation member 81 is axially supported by the lower wall 70. A large spur gear 85 is attached to substantially the intermediate portion of the rotating shaft 83, and a pin gear 86 is attached to the rear portion of the rotating shaft 83. The large spur gear 85 meshes with a mid small gear 93 which is pivotally attached to the circumferential wall 69.

The pin gear 86 meshes with a mid spur gear 87 pivotally and axially supported on the lower surface of the bottom wall 6. The mid spur gear 87 is integrally provided with a driving gear 89. The driving gear 89 meshes with the rack 39 of the rotary disk 36 through an opening 8 formed in the bottom wall 6. A power transmission shaft 90 is pivotally provided to the circumferential wall 69 to be substantially parallel to the rotating shaft 83. A small gear 91 is stationarily attached to the front portion of the power transmission shaft 90, and an output bevel gear 92 is stationarily attached to the rear portion of the power transmission shaft 90. The output bevel gear 92 meshes with an input bevel gear 103 provided to the rotating shaft of the coin selector 100 (to be described later). The power transmission means 95 comprises the rotating shaft 83, pin gear 86, mid spur gear 87, and driving gear 89.

The control room 5 has the coin selector storage 62 arranged on the right of the article storage chamber 3, and the stage portion 61 arranged under the article storage chamber 3. The coin selector storage 62 and stage portion 61 are vertically partitioned by the partition wall 46 which extends outwardly from the periphery of the lower end of the guide wall 7 horizontally. The power transmission means 95 described above is arranged above the partition wall 46. The coin selector storage 62 formed of the semicylindrical right-side wall 63, arcuate front wall 65, lower wall 67, and semicylindrical vertical wall 11 is partitioned by the partition wall 46. The coin selector 100 is arranged above the partition wall 46. The coin storage case 115 which stores and recovers coins discharged from the coin selector 100 is arranged under the partition wall 46. As the coin storage case 115 is surrounded by the front wall 65, right-side wall 63, and lower wall 67 of the coin selector storage 62, the coin storage case 115 can be accessed through the lower opening 64 formed in the rear surface of the equipment body 2.

The coin selector 100 is mounted through the controlling opening 60 formed in the rear surface of the equipment body 2. The number of coins to be inserted can be set in the coin selector 100. The coin inlet 102 is formed in the upper portion of the front surface of a coin selector main body 101. A coin return pushbutton 104 is formed under the coin inlet 102. The input bevel gear 103 is arranged at the lower portion of the left surface of the coin selector main body 101. When a required number of coins are inserted in the coin selector 100 through the coin inlet 102, the input bevel gear 103 becomes pivotal. If the number of inserted coins is insufficient or if a counterfeit coin is inserted, the input bevel gear 103 stays nonpivotal. Four engaging shafts 105 project substantially horizontally from the two sides of the lower portion of the coin selector main body 101.

Above the partition wall 46 in the coin selector storage 62, a pair of guide walls 106, 106 extend in the back-and-forth direction. Each guide wall 106, 106 has engaging grooves 107 . . . formed by substantially L-shaped projection pieces 109. The coin selector 100 is attached to be movable in the back-and-forth direction as it is guided by the pair of guide walls 106, 106, and is positioned as the engaging shafts 105 engage in the engaging grooves 107 . . . . When the coin selector 100 is positioned in the above manner, the rear end of the coin selector main body 101 is locked by a locking pawl 110 provided to the partition wall 46.

A guide edge 112 extending in the back-and-forth direction is formed in the lower portion of the partition wall 46. The coin storage case 115 described above is attached to be movable in the back-and-forth direction as its upper end edge 116 is guided by the guide edge 112. The front wall 65 of the coin selector storage 62 has the vertical wall 66. The coin slot 120 which opposes the coin inlet 102 of the coin selector 100 is formed in the upper portion of the front surface of the vertical wall 66 (i.e., the front side of the equipment body 2). An insertion hole 121 through which the coin return pushbutton 104 of the coin selector 100 is inserted is formed under the coin slot 120. A semicylindrical swelling portion 125 is formed at substantially the intermediate portion of the front surface of the vertical wall 66 of the coin selector storage 62. The swelling portion 125 has the rectangular opening 126.

A pair of bearing portions 129, 129 are formed on the rear surface of the vertical wall 66 of the coin selector storage 62. A center shaft 131 of the cylindrical rotary cylindrical portion 130 is pivotally attached to the pair of bearing portions 129, 129. The rotary cylindrical portion 130 exposes from the opening 126. The plurality of stages of displays 134 for displaying the price and content of the article, the inserted number of coins, and the like are formed on the outer surface of the rotary cylindrical portion 130. The displays 134 are display sheets, and can naturally be mounted in a rectangular recess 138 formed in the outer surface of the rotary cylindrical portion 130.

The center shaft 131 is formed to have a rectangular section. Elastic pieces 133 each having a substantially triangular press portion 132 to press the center shaft 131 are respectively provided to the bearing portions 129. The elastic pieces 133 can position the center shaft 131, and unpivotally lock the rotary cylindrical portion 130 so the displays 134 which display the amount of inserted money and the like through the opening 126 are not accidentally changed. The rotary cylindrical portion 130 can rotate against the elasticities of the elastic pieces 133. The displays 134 which display the amount of inserted money and the like can naturally be changed.

The cover member 135 is pivotally attached to the center shaft 131. The cover member 135 comprises a semicylindrical cover member 136 made of a transparent material, semicircular side walls 137 provided to the two ends of the cover member 136, and the engaging member 139 provided to the lower edge of the cover member 136. The cover member 136 pivots to close the opening 126 so as to cover the rotary cylindrical portion 130 as the substantial centers of the side walls 137 are pivotally supported by the center shaft 131. The engaging member 139 is formed to have a plate-like shape and has an engaging projection 140 at its lower end. When the engaging projection 140 engages with a lower portion 141 of the coin selector 100, the cover member 136 is fixed as it closes the opening portion 126.

The controlling opening 60 is closed with the lid member 150. The lid member 150 comprises a first lid portion 151 which closes the rear opening 68 of the controlling opening 60, a second lid portion 152 which closes the lower opening 64, and a third lid portion 153 which closes the access opening 16 of the article storage chamber 3. A pair of locking pawls 156 are formed on an upper end edge 142 of the first lid portion 151, and locked by an upper end edge 143 of the front wall 65. The second lid member 152 has a lock 157 provided with an engaging/disengaging key 158. When the key 158 is inserted in the lock 157 and pivoted, the lock 157 engages with an engaging target plate 159 provided to the lower wall 70, so that the lid member 150 can be unremovably attached to the equipment body 2. When the lid member 150 is attached, it presses the operation piece 53 of the lock means 50. The locking projection 52 pivots in the anti-locking direction against the elasticity of the elastic member 56 and disengages from the rack 39 of the rotary disk 36, thus rendering the rotary disk 36 rotatable.

The article retrieval equipment 1 has the above arrangement. The coin slot 120, coin return pushbutton 104, operation member 81, and article outlet 72 are formed on the front surface of the article retrieval equipment 1. The controlling opening 60 for the control room 5 and the access opening 16 for the article storage chamber 3 are formed in the rear surface of the article retrieval equipment 1. The controlling opening 60 and access opening 16 are closed with the lid member 150. When the key 158 is inserted in the lock 157 and pivoted, the lock 157 disengages from the engaging target plate 159, so the lid member 150 can be removed from the equipment body 2 (see FIG. 3).

When the lid member 150 is removed from the equipment body 2, the lid member 150 no longer presses the operation piece 53 of the lock means 50. The locking projection 52 pivots in the locking direction by the elasticity of the elastic member 56, and locks the rack 39 of the rotary disk 36 to render the rotary disk 36 unrotatable. When coins are accumulated in the coin storage case 115, the coin storage case 115 is pulled out backward from the lower opening 64 in the rear surface of the equipment body 2, and the coins are extracted. Then, the coin storage case 115 is pushed in forward to be stored in the coin selector storage 62.

The articles A or B, e.g., capsules incorporating inexpensive toys, are stored through the access opening 16 of the article storage chamber 3. In the case of large articles A, the operation member 35 is pulled to the front side. In the case of small articles B, the operation member 35 is pushed in. When the operation member 35 is pushed in, the guide member 30 pivots clockwise along the recess 23, so that the guide projection 33 closes the falling port 22 by about ⅓ (see FIGS. 4B and 7B). The guide member 30 moves upward as its inclined walls 31 and 32 are guided by the inclined portions 28 of the inclined projections 26, to ride on the horizontal portions 27 of the inclined projections 26. As the guide member 30 projects from the bottom wall 6 in this manner, the positions of the articles A and B to be guided by the accommodation holes 37 of the rotary disk 36 can be set high.

Figure 7B:
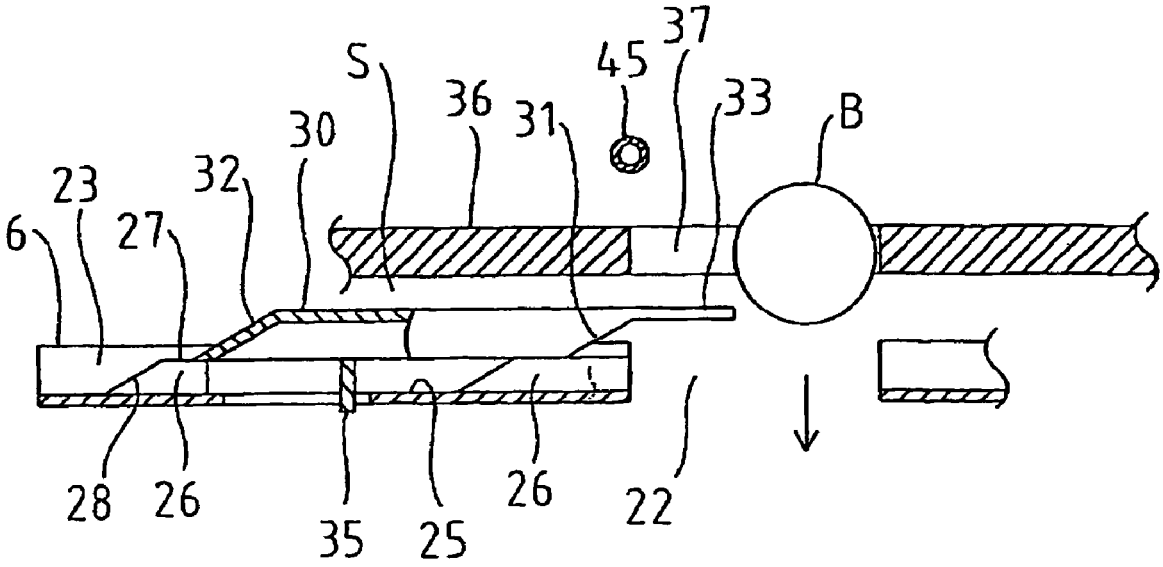
Figure 8:
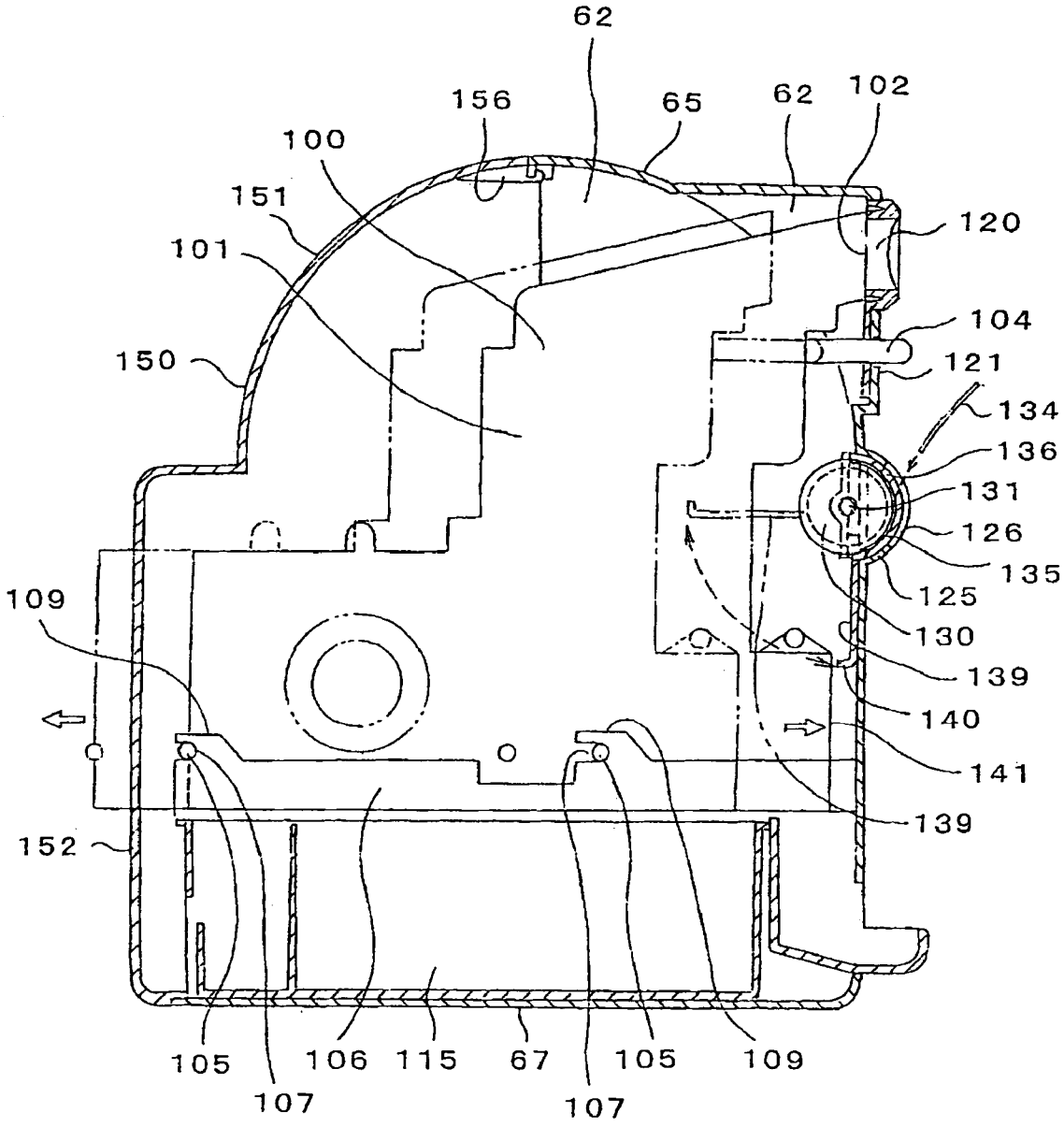
FIG. 8 is a side sectional view for explaining a transparent cover for a price display.

When the operation member 35 is pulled to the front, the guide member 30 pivots counterclockwise along the recess 23, and the guide projection 33 opens the falling port 22 (see FIGS. 4A and 7B). The guide member 30 moves downward as the inclined walls 31 and 32 are guided by the inclined portions 28 of the inclined projections 26, and is stored in the recess 23. Since the guide member 30 is set at the same height as that of the bottom wall 6 in this manner, the positions of the articles A and B guided by the accommodation holes 37 of the rotary disk 36 can be set low. According to this embodiment, at first, the operation member 35 is pulled to the front, and large articles A are stored in the article storage chamber 3 through the access opening 16.

When the coin selector 100 is pulled out from the coin selector storage 62, an engaging member 139 of the cover member 136 no longer engages with the lower portion 141 of the coin selector 100, and accordingly the cover member 136 becomes pivotal. When the operator inserts his or her hand in the controlling opening 60 (rear opening 68) located in the rear surface of the equipment body 2 to pull the engaging member 139 upward, the cover member 136 disengages from the opening 126, and the displays 134 of the rotary cylindrical portion 130 expose from the opening 126. The operator inserts his or her finger in the opening 126 to pivot the rotary cylindrical portion 130, to change the displays 134 to correspond to the articles A. When the engaging member 139 is pulled downward, the cover member 136 pivots to cover the rotary cylindrical portion 130 so as to close the opening 126. When the coin selector 100 is stored in the coin selector storage 62, the input bevel gear 103 of the coin selector 100 meshes with the output bevel gear 92. The lower portion 141 of the coin selector 100 engages with the engaging member 139, and the cover member 136 is fixed as it closes the opening portion 126.

When the pair of locking pawls 156 of the lid member 150 lock the upper end edge 143 of the front wall 65 to close the controlling opening 60 with the prohibition door 150, the first lid portion 151 closes the rear opening 68, the second lid portion 152 closes the lower opening 64, and the third lid portion 153 closes the access opening 16 of the article storage chamber 3. When the key 158 is inserted in the lock 157 of the lid member 150 and pivoted, the lid member 150 is unremovably attached to the equipment body 2. When the lid member 150 is attached, it presses the operation piece 53 of the lock means 50, the locking projection 52 pivots in the counterlocking direction against the elasticity of the elastic member 56 to disengage from the rack 39 of the rotary disk 36, to render the rotary disk 36 rotatable.

In accordance with the displays 134 of the rotary cylindrical portion 130, when a predetermined number of coins are inserted in the coin inlet 102 of the article retrieval equipment through the coin slot 120, the input bevel gear 103 becomes pivotal, and accordingly the large spur gear 85, mid small gear 93, small gear 91, power transmission shaft 90, output bevel gear 92, and input bevel gear 103 also become rotatable. In this state, when the operation member 81 is rotated, the rotation of the operation member 81 rotates the rotary disk 36 for a predetermined amount through the rotating shaft 83, pin gear 86, mid spur gear 87, driving gear 89, and rack 39. If the predetermined number of coins are not inserted or if a counterfeit coin is inserted in the coin inlet 102, the input bevel gear 103 becomes nonpivotal, and accordingly the large spur gear 85, mid small gear 93, small gear 91, power transmission shaft 90, output bevel gear 92, and input bevel gear 103 also become unrotatable, so the operation member 81 does not rotate.

When the rotary disk 36 rotates by the predetermined amount, an article A stored in a accommodation hole 37 of the rotary disk 36 is transported to above the falling port 22 and falls into the falling port 22, as shown in FIG. 7A, rolls on the falling passage 71 to push the lid body 77 open, and falls into the article accepting portion 73 through the article outlet 72.

When the articles B are to be stored in the article storage chamber 3, the key 158 is inserted in the lock 157 and pivoted, as described above. Then, the lock 157 disengages from the engaging target plate 159, so that the lid member 150 can be removed from the equipment body 2 (see FIG. 3). The articles B are stored through the access opening 16 of the article storage chamber 3. Because the articles B are small, the operation member 35 is pushed in. When the operation member 35 is pushed in, the guide projection 33 closes the falling port 22 by about ⅓ (see FIGS. 4B and 7B, and the guide member 30 projects from the bottom wall 6. Thus, the positions of the articles B to be guided by the accommodation holes 37 of the rotary disk 36 can be set high.

The coin selector 100 is pulled out from the coin selector storage 62. The cover member 136 is pivoted to expose the displays 134 of the rotary cylindrical portion 130 through the opening 126, and the displays 134 are changed to correspond to the articles B. The engaging member 139 is pulled down. The cover member 136 closes the opening 126 to cover the rotary cylindrical portion 130. The coin selector 100 is stored in the coin selector storage 62. The lower portion 141 of the coin selector 100 is engaged with the engaging member 139. The cover member 136 is fixed as it closes the opening 126.

The controlling opening 60 is closed with the lid member 150. In accordance with the displays 134 of the rotary cylindrical portion 130, a predetermined number of coins are inserted in the coin inlet 102 of the article retrieval equipment 1 through the coin slot 120. When the operation member 81 is rotated, the rotary disk 36 rotates by a predetermined amount, and the article B stored in an accommodation hole 37 of the rotary disk 36 is transported to above the falling port 22 and falls into the falling port 22, as shown in FIG. 7B, rolls on the falling passage 71 to push the lid body 77 open, and falls into the article accepting portion 73 from the article outlet 72.

A gap S2 between the rotary disk 36 and guide member 30 is smaller than a gap S1 between the rotary disk 36 and bottom wall 6. Even a small article B is not caught under the rotary disk 36 but transported to the falling port 22 smoothly. If a plurality of articles B are stored in one accommodation hole 37, the preventive spring 46 expels them but one. The guide projection 33 causes the article B to fall at a position spaced apart from the lid body 77 (see FIG. 5). The article B is speeded than in a case wherein it falls near the lid body 77, and rolls on the falling passage 71 to push the lid body 77 open. Therefore, even an article B which is more lightweight than the article A is not interfered with by the lid body 77 from falling, and clogging of the article B can be prevented.

[Effect of the Invention]

As has been described above, in an article retrieval equipment according to the present invention, portions such as a coin inlet, article outlet, and operation part which are used by the customer are arranged on the front surface of an equipment body, portions such as a coin storage case which are used by the sales person to replenish articles and control a coin selector and power transmission means are arranged on the rear surface of the equipment body. The article retrieval equipment is placed between the sales person and customer. This arrangement is particularly suitable when the article retrieval equipment is to be used by the sales person and customer face to face.

In an article retrieval equipment according to the present invention, a control room which stores a coin selector is formed beside an article storage chamber which stores articles such as capsules. An article outlet, an operation part, a coin inlet, a controlling opening through which a coin storage case can be pulled out, and a lid member which opens and closes the controlling opening are provided to the control room. Thus, the article retrieval equipment can be made compact. Therefore, the article retrieval equipment can be installed in a narrow space of a small shop or the like. The problem of where to install the article retrieval equipment thus diminishes.

In an article retrieval equipment according to the present invention, an access opening through which articles are unloaded and loaded is formed in an article storage chamber which stores articles such as capsules. A controlling opening, through which a power transmission means can be controlled and a coin storage case can be pulled out, is formed in a control room which stores the power transmission means and a coin selector. A lid member is provided to open and close the access opening and controlling opening. Only one key needs to be attached to the lid member, leading to easy management.

An article retrieval equipment according to the present invention is provided with a lock means which unrotatably locks a rotary disk when a lid member is opened, and rotatably unlocks the rotary disk when the lid member is closed. The rotary disk will not rotate accidentally in the article unloading/loading operation when the lid member is removed from the equipment body.

In an article retrieval equipment according to the present invention, a height adjusting means which can adjust the positions in the direction of height of articles accommodated in accommodation holes of a rotary disk is provided to the bottom wall of an article storage chamber which stores the articles. The positions in the direction of height of the articles can be adjusted in accordance with the sizes of the articles to be stored in the article storage chamber. A comparatively small article will not be caught between the bottom wall and rotary disk to interfere with the rotation of the rotary disk. The articles can thus be transported to a falling port smoothly. This can prevent a plurality of articles from falling to the falling port simultaneously.

In an article retrieval equipment according to the present invention, a fall adjusting means which can adjust the falling positions of articles falling from a falling port is provided to the bottom wall of an article storage chamber which stores the articles. The falling position where the article falls onto a falling passage from a falling port is spaced apart from an opening/closing door so the falling article can be speeded. Thus, cases wherein a small, lightweight article is undesirably stopped by the opening/closing door can decrease.

An article retrieval equipment according to the present invention has an article storage chamber which stores articles, and a control room which stores a coin selector. A rotary cylindrical portion provided with displays which display the price and content of articles, the number of coins to be inserted, and the like is pivotally arranged in the opening of an equipment body. A cover member is pivotally provided which covers the displays of the rotary cylindrical portion exposing from the opening and is made of a transparent material. The cover member can be fixed by the coin selector. When the coin selector is to be stored, the displays can be prevented from being accidentally changed by the fixed cover member. When the coin selector is to be removed, the cover member is disengaged and pivots to expose the displays of the rotary cylindrical portion. The rotary cylindrical portion can be pivoted to change the displays.

[Description of the Reference Numerals]

A . . . article, B . . . article, S . . . space, 1 . . . article retrieval equipment; 2 . . . equipment body; 3 . . . article storage chamber (first storage chamber); 4 . . . support chamber; 5 . . . control room (second storage chamber); 6 . . . bottom wall; 7 . . . guide wall; 8 . . . opening; 9 . . . inclined wall; 10 . . . projecting edge; 11 . . . vertical wall; 12 . . . rear wall; 13 . . . recess; 15 . . . cover body; 16 . . . access opening (article loading port); 17 . . . lower end; 20 . . . support shaft; 21 . . . flange; 22 . . . falling port; 23 . . . recess; 25 . . . bottom portion; 26 . . . inclined projection; 27 . . . horizontal portion; 28 . . . inclined portion; 30 . . . guide member (adjusting means); 31 . . . inclined wall; 32 . . . inclined wall; 33 . . . guide projection; 35 . . . operation member; 36 . . . rotary disk (guide means); 37 . . . accommodation hole; 39 . . . rack; 41 . . . article distribution shaft; 42 . . . stirring spring; 43 . . . screw; 45 . . . preventive spring; 46 . . . partition wall; 47 . . . elongated groove; 50 . . . lock means; 51 . . . bearing portion; 52 . . . locking projection; 53 . . . operation piece; 55 . . . opening; 56 . . . elastic member; 60 . . . controlling opening; 61 . . . stage portion; 62 . . . coin selector storage; 63 . . . right-side wall; 64 . . . lower opening; 65 . . . front wall; 66 . . . vertical surface; 67 . . . lower wall; 68 . . . rear opening; 69 . . . circumferential wall; 70 . . . lower wall; 71 . . . falling passage; 72 . . . article outlet; 73 . . . article accepting portion; 74 . . . rear portion; 75 . . . inclined rib; 76 . . . bearing recess; 77 . . . lid body; 78 . . . rear portion; 79 . . . support shaft; 80 . . . engaging edge; 81 . . . operation member (operation part); 83 . . . rotating shaft; 85 . . . large spur gear; 86 . . . pin gear; 87 . . . mid spur gear; 89 . . . driving gear; 90 . . . power transmission shaft; 91 . . . small gear; 92 . . . output bevel gear; 93 . . . mid small gear; 95 . . . power transmission means; 100 . . . coin selector (coin detection means); 101 . . . coin selector main body; 102 . . . coin inlet; 103 . . . input bevel gear; 104 . . . coin return pushbutton; 105 . . . engaging shaft; 106 . . . guide wall; 107 . . . engaging groove; 109 . . . projection piece; 110 . . . locking pawl; 112 . . . guide edge; 115 . . . coin storage case; 116 . . . upper end edge; 120 . . . coin slot; 121 . . . insertion hole; 125 . . . swelling portion; 126 . . . opening; 129 . . . bearing portion; 130 . . . rotary cylindrical portion; 131 . . . center shaft; 132 . . . press portion; 133 . . . elastic piece; 134 . . . display; 135 . . . cover member; 136 . . . cover member; 137 . . . side wall; 138 . . . recess; 139 . . . engaging member; 140 . . . engaging projection; 141 . . . lower portion; 142 . . . upper end edge; 143 . . . upper end edge; 150 . . . lid member (prohibition door); 151 . . . first lid portion; 152 . . . second lid portion; 153 . . . third lid portion; 156 . . . locking pawl; 157 . . . lock; 158 . . . key; 159 . . . engaging target plate

INDUSTRIAL APPLICABILITY

The present invention can be utilized by an article retrieval equipment from which articles such as capsules arranged in an equipment body can be retrieved one by one by operating the operation part of the equipment body.

The invention claimed is:

1. An article retrieval equipment comprising:

(a) an equipment body having an article storage chamber which stores an article, (b) a bottom wall in said article storage chamber that is provided with a pivotal rotary disk having an accommodation hole to accommodate the article and a falling port which opposes said accommodation hole of said rotary disk, (c) a falling passage formed in a lower portion of said equipment body which communicates with an article outlet opposing said falling port of said article storage chamber body, (d) an operation part in said equipment body which rotates said rotary disk to oppose said accommodation hole to said falling port and allows the article accommodated in said accommodation hole to fall into said article outlet through said falling port and falling passage, and (e) height adjusting means, having a guide member provided in a recess formed in said bottom wall, for adjusting a position in a direction of the article accommodated in said accommodation hole of said rotary disk.

2. The article retrieval equipment according to claim 1, wherein said guide member has an operation part projecting from an elongated groove formed in one side of said article storage chamber, and serves to move upward along an inclined projection formed on said recess of said bottom wall when operated in one direction by said operation part and move downward along said inclined projection when operated in the other direction by said operation part.

3. An article retrieval equipment comprising:

(a) an equipment body having an article storage chamber which stores an article, (b) a bottom wall in said article storage chamber that is provided with a pivotal rotary disk having an accommodation hole to accommodate the article and a falling port which opposes said accommodation hole of said rotary disk, (c) a falling passage formed in a lower portion of said equipment body which communicates with an article outlet opposing said falling port of said article storage chamber, (d) an operation part in said equipment body which rotates said rotary disk to oppose said accommodation hole to said falling port and allows the article accommodated in said accommodation hole to fall into said article outlet through said falling port and falling passage, (e) height adjusting means, having a guide member provided in a recess formed in said bottom wall, for adjusting a position in a direction of height of the article accommodated in said accommodation hole of said rotary disk, and (f) fall adjusting means for adjusting a falling position of the article which falls from said falling port.

4. The article retrieval equipment according to claim 3, wherein (a) said fall adjusting means comprises a guide member provided to said bottom wall, and (b) said guide member has an operation part projecting from an elongated groove formed in one side of said article storage chamber, and serves to narrow said falling port, when operated in one direction by said operation part, to set a falling position of the article at a position spaced apart from said article outlet, and enlarge said falling port when operated in the other direction by said operation part.

5. An article retrieval equipment according to claim 3, wherein (a) said equipment body has a control room which stores power transmission means and a coin selector, (b) said operation part rotates said rotary disk through said power transmission means to cause said accommodation hole to oppose said falling port and allows the article accommodated in said accommodation hole to fall into said article outlet through said falling port and falling passage, (c) said coin selector renders one of said rotary disk and power transmission means rotatable with a coin inserted through a coin inlet and is provided with a coin storage case thereunder, (d) said article storage chamber has an access opening through which the article is unloaded and loaded, (e) said control room has a controlling opening through which said power transmission means is controlled and said coin storage case can be pulled out, (f) said equipment body is provided with a lid member which opens and closes said access opening and controlling opening, (g) said equipment body is provided with a display which displays a price and content of the article, and the number of coins to be inserted, (h) coin detection means, arranged between said coin inlet and coin storage case, for detecting that a coin is loaded from said coin inlet, and (i) said operation part is located between said rotary disk and coin detection means and become operative after a coin is detected by said coin detection means.

* * * * *

UNITED STATES PATENT AND TRADEMARK OFFICE

CERTIFICATE OF CORRECTION

PATENT NO. : 7,513,391 B2
APPLICATION NO. : 11/299652
DATED : April 7, 2009
INVENTOR(S) : Yasuyuki Nakanishi It is certified that error appears in the above-identified patent and that said Letters Patent is hereby corrected as shown below:

| | |
|---|---|
| Column 3, Lines 43-67: | delete Column 3, Lines 43-67 |
| Column 4, Lines 1-67: | delete Column 4, Lines 1-67 |
| Column 5, Lines 1-67: | delete Column 5, Lines 1-67 |
| Column 6, Lines 1-67: | delete Column 6, Lines 1-67 |
| Column 7, Lines 1-50: | delete Column 7, Lines 1-50 |
| Column 8, Line 18: | delete “in addition to the” |
| Column 8, Line 19: | delete “above arrangement” |
| Column 8, Line 44: | delete “fifth” |
| Column 8, Line 45: | delete “according to claim 17 of the present invention” |
| Column 8, Lines 58-67: | delete Column 8, Lines 58-67 |
| Column 9, Lines 1-67: | delete Column 9, Lines 1-67 |
| Column 10, Lines 1-67: | delete Column 10, Lines 1-67 |
| Column 11, Lines 1-33: | delete Column 11, Lines 1-33 |
| Column 17, Line 15: | insert -- ··· -- after **105** [Should read: engaging shafts **105** ··· engage] |
| Claim 1, Column 22, Line 62: | delete “body” |

UNITED STATES PATENT AND TRADEMARK OFFICE

CERTIFICATE OF CORRECTION

PATENT NO. : 7,513,391 B2
APPLICATION NO. : 11/299652
DATED : April 7, 2009
INVENTOR(S) : Yasuyuki Nakanishi It is certified that error appears in the above-identified patent and that said Letters Patent is hereby corrected as shown below:

Claim 1, Column 23, Line 3: insert --of height-- [Should read: a position in a direction of height of the article]

Signed and Sealed this

Third Day of November, 2009

David J. Kappos

David J. Kappos
*Director of the United States Patent and Trademark Office*